United States Patent [19]

Baumann et al.

[11] 4,060,387

[45] Nov. 29, 1977

[54] AROMATIC CARBOXYLIC ACID ESTERS AND AMIDES AS FIXING AGENTS

[75] Inventors: Hans-Peter Baumann, Allschwil; Hans-Georg Karmann, Binningen, both of Switzerland

[73] Assignee: Sandoz Ltd., Basel, Switzerland

[21] Appl. No.: 630,089

[22] Filed: Nov. 10, 1975

Related U.S. Application Data

[62] Division of Ser. No. 404,696, Oct. 9, 1973, Pat. No. 3,950,419.

[30] Foreign Application Priority Data

Oct. 13, 1972 Switzerland ..... 15035/72

[51] Int. Cl.[2] ..... D06P 5/04

[52] U.S. Cl. ..... 8/169; 8/74; 8/172 A

[58] Field of Search ..... 8/169, 74, 97, 172, 8/173

[56] References Cited

U.S. PATENT DOCUMENTS

| | | | |
|---|---|---|---|
| 1,970,578 | 8/1934 | Schoeller et al. | 252/DIG. 1 |
| 2,183,853 | 12/1939 | Haussmann et al. | 252/DIG. 1 |
| 3,653,800 | 4/1972 | Blackwell | 88/21 C |
| 3,744,967 | 7/1973 | Thackrah | 8/173 |
| 3,917,447 | 11/1975 | Lazar et al. | 8/173 |

*Primary Examiner*—William E. Schulz
*Attorney, Agent, or Firm*—Gerald D. Sharkin; Richard E. Vila; Thomas C. Doyle

[57] ABSTRACT

The present invention relates to methods of dyeing and printing of textile materials and specifically to the use of fixing agents in such methods. In particular, the present invention relates to the use of aromatic carboxylic acid esters and amides as fixing agents in the dyeing and printing of textile materials.

15 Claims, No Drawings

AROMATIC CARBOXYLIC ACID ESTERS AND AMIDES AS FIXING AGENTS

This application is a division of our copending application Ser. No. 404,696, filed Oct. 9, 1973 and now U.S. Pat. No. 3,950,419.

The present invention relates to methods of dyeing and printing of textile materials and specifically to the use of fixing agents in such methods. In particular, the present invention relates to the use of aromatic carboxylic acid esters and amides as fixing agents in the dyeing and printing of textile materials.

The dyeing or printing of textile materials often causes difficulty if carried out in the absence of a fixing agent, particularly when the textile fibres contain no or few functional groups reactive towards the particular dye employed. Thus, problems have been experienced in the dyeing of textiles consisting of, or including, such synthetic fibres as polyesters, cellulose 2½ acetate, cellulose triacetate or polyvinyl chloride, especially when deep shades are required and particularly when disperse dyes are employed.

Accordingly, the present invention provides a method of dyeing or printing a fabric consisting of or containing polyester, cellulose 2½ acetate, cellulose triacetate or polyvinyl chloride which comprises treating said fabric before, during or after dyeing or printing, with a compound of formula I,

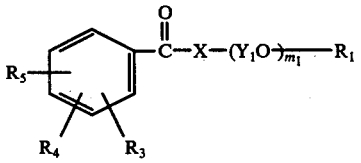

wherein

X is —O— or —NR—,

R is hydrogen, phenyl, phenylalkyl ($C_7$–$C_{22}$) phenyl or phenylalkyl ($C_7$–$C_{22}$) substituted by —OH, alkyl or halogen and having up to 22 carbon atoms in the aggregate thereof, alkyl ($C_1$–$C_{22}$), cycloalkyl ($C_5$–$C_7$), alkyl ($C_1$–$C_{15}$) cycloalkyl ($C_5$–$C_7$), cycloalkyl ($C_5$–$C_7$) alkyl ($C_1$–$C_{15}$), alkyl ($C_1$–$C_{15}$) cycloalkyl ($C_5$–$C_7$) alkyl ($C_1$–$C_{15}$) or a group —($Y_2$—O)$_{m_2}$—$R_2$ $Y_1$ and $X_2$ are, independently, ethylene, 1,2-propylene, 1,3-propylene, 1,2-butylene or phenylethylene, with the proviso that a) only the group $Y_1$ or $Y_2$ which is bound to —X—, can be 1,3-propylene, and b) each ($Y_1$—O) or ($Y_2$—O) chain contains no more than 2 phenylethylene groups, $R_1$ and $R_2$ are, independently, hydrogen, phenyl, phenylalkyl ($C_7$–$C_{22}$), phenyl or phenylalkyl substituted on the phenyl nucleus by —OH, alkyl or halogen and having up to 22 carbon atoms in the aggregate thereof, alkyl ($C_1$–$C_{22}$), cycloalkyl ($C_5$–$C_7$), alkyl ($C_1$–$C_{15}$) cycloalkyl ($C_5$–$C_7$), cycloalkyl ($C_5$–$C_7$) alkyl ($C_1$–$C_{15}$), alkyl ($C_1$–$C_{15}$) cycloalkyl ($C_5$–$C_7$) alkyl ($C_1$–$C_{15}$), or a group

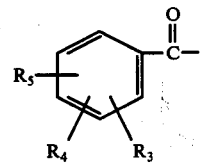

$R_3$ is hydrogen, halogen, alkyl ($C_1$–$C_{22}$), cycloalkyl ($C_5$–$C_7$), cycloalkyl ($C_5$–$C_7$) alkyl ($C_1$–$C_{15}$), alkyl ($C_1$–$C_{15}$) cycloalkyl ($C_5$–$C_7$), alkyl ($C_1$–$C_{15}$) cycloalkyl ($C_5$–$C_7$) alkyl ($C_1$–$C_{15}$), —CN, —$COOR_6$, —$SO_3R_6$, —$OR_6$, —$NHR_6$ or —$N(R_6)_2$, —$CO_2M$, —$SO_3M$ or a group —CO—X—($Y_1O$)$_{m_1}$—$R_1$, $R_4$ is hydrogen, —$CO_2M$, —$OR_6$ or a group —CO—X—($Y_1O$)$_{m_1}$—$R_1$, $R_5$ is hydrogen, —$CO_2M$ or a group —CO—X—($Y_1$-O)$_{m_1}$—$R_1$, M is a charge equivalent of a cation, $m_1$ and $m_2$ are integers 1 to 100, the sum of all integers $m_1$ and $m_2$ being 1 to 100, and $R_6$ is hydrogen or a group R.

By the term "halogen" is meant fluorine, chlorine or bromine.

It is to be understood that the significances of $Y_1$ in re-occurring units of ($Y_1O$)— may be the same or different and similarly for $Y_2$.

The substituents R, $R_1$, $R_2$ and $R_3$ may signify, for example, an alkyl radical with up to 22 carbon atoms. As examples, may be mentioned methyl, ethyl, propyl, butyl, pentyl, hexyl, octyl, nonyl, decyl, lauryl, myristyl, cetyl, stearyl and behenyl radicals. Examples of branched radicals are isopropyl, 2-butyl and 2-hexyl radicals. Examples of cycloalkyl and cycloalkylalkyl radicals are cyclohexyl, cyclohexylmethyl and cyclohexylethyl.

Preferable alkyl substituents on a phenyl nucleus, contain 1 to 4, especially 1 to 3 carbon atoms.

Examples of phenylalkyl radicals are benzyl, phenylethyl, 2-hydroxybenzyl and 2-chlorophenylethyl. Examples of phenyl radicals are 2chlorophenyl, 4-hydroxyphenyl and 4-toluyl.

M signifies preferably hydrogen, or a monovalent cation such as $Na^{\oplus}$ $K^{\oplus}$ $NH_4^{\oplus}$ whereby the nitrogen atom may also be present as an organic amine such as methylamine ($CH_3NH_3^{\oplus}$) or another alkylamine or phenylamine.

Preferably, X is —NR—. In addition, the compounds of formula I wherein $Y_1$ and $Y_2$ are ethylene, 1,2-propylene and 1,2-butylene are preferred.

Preferably, the sum of all the integers $m_1$ and $m_2$ is 4 to 50 and when the compounds are amides, then said sum is preferably 4 to 20, especially 5 to 20.

Preferably, $R_1$ and $R_2$ are hydrogen or alkyl, particularly hydrogen.

$R_3$ is preferably hydrogen, Cl, —O—($Y_2O$)$_{m_2}$—H, —$CH_3$, —CN, —$SO_3$($Y_2O$)$_{m_2}$—H, —$OCH_3$ or especially

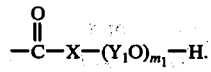

A preferred group of compounds are the compounds of formula Ia,

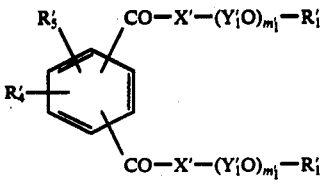

Ia wherein

X' is —O— or —NR'—

R' is hydrogen or a group $—(Y_2'O_{m2'}R_2'$ $Y_1'$ and $Y_2'$ are, independently, ethylene, 1,2-propylene or 1,2-butylene, $R_1'$ and $R_2'$ are, independently, hydrogen or alkyl ($C_1$—$C_4$), $R_4'$ is hydrogen, $CO_2M$ or $OR_6'$, $R_5'$ is hydrogen or $CO_2M$, $R_6'$ is hydrogen or a group $—(Y_2'O)_{m_2'}R_2'$, M is as defined above, and $m_1'$ and $m_2'$ are each an integer 1 to 49, the sum of all integers $m_1'$ and $m_2'$ being 2 to 50.

Of particular interest are the compounds of formula Ib,

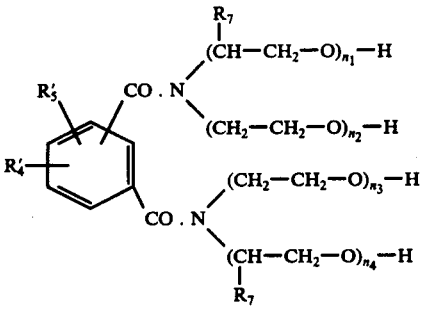

Ib wherein $R_4'$ and $R_5'$ are as defined above, $R_7$ is hydrogen or methyl, and each of $n_1$, $n_2$, $n_3$ and $n_4$ is an integer 1 to 37, the sum of $n_1$, $n_2$, $n_3$ and $n_4$ being 4 to 40, especially 5 to 40, particularly 5 to 20, especially, the compounds of formula Ic,

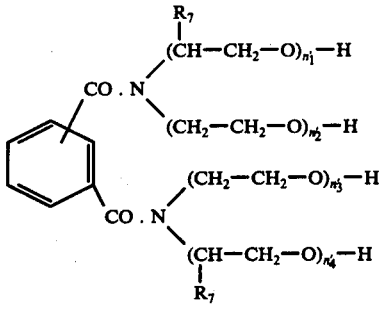

Ic wherein $R_7$ is as defined above, and $n_1'$, $n_2'$, $n_3'$ and $n_4'$ are each an integer 1 to 17, the sum of $n_1'$, $n_2'$, $n_3'$ and $n_4'$ being 4 to 20.

Again it is to be appreciated that the value of $R_7$, in re-occurring units of

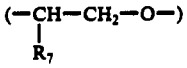

may be the same or different.

Of the compounds of formulae Ib or Ic, wherein the amide side chains may be in the ortho, meta or para relative positions on the phenyl nucleus, the compounds wherein the amide side chains are in ortho relative positions are preferred. In addition, the compounds of formula Ic wherein the sum of $n_1'$, $n_2'$, $n_3'$ and $n_4'$ is 6 to 8, are of special interest, especially the compounds of formula Id,

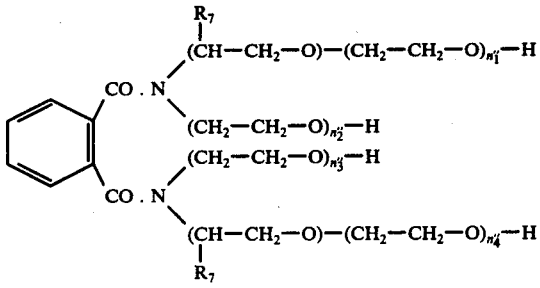

Id wherein $R_7$ is as defined above, and $n_4'$, $n_2''$, $n_3''$ and $n_4''$ are integers 1 to 3, the sum of $n_1''$, $n_2''$, $n_3''$ and $n_4''$ being 4 to 6.

Some of the compounds of formula I are new, e.g. the compounds of formula In,

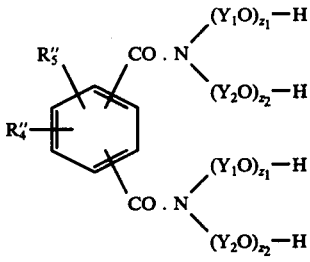

In wherein $Y_1$ and $Y_2$ are as defined above, $R_4''$ and $R_5''$ have the same meaning as $R_4$ and $R_5$, respectively, with the proviso that when $R_4$ or $R_5$ is a group $—CO—X—(Y_1O)_{m1}—R_1$ or a group $—(Y_3—O)_{m2}—R_2$, then $R_1$ and $R_2$ are hydrogen, and $z_1$ and $z_2$ are integers 1 to 97, the sum of all the integers $z_1$ and $z_2$ being 5 to 100, and when relevant, the sum of all the integers $z_1$, $z_2$, $m_1$ and $m_2$ being 6 to 100.

Of the compounds of formula In, and as will be clear from the foregoing disclosure, preferred are the compounds of formula In a, In a

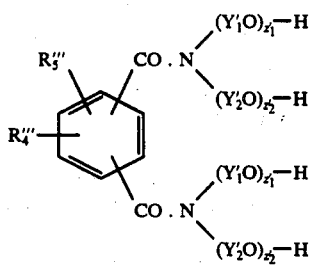

wherein $Y_1'$ and $Y_2'$ are as defined above, $R_4'''$ and $R_5'''$ have the same meaning as $R_4'$ and $R_5'$ with the proviso that when $R_4'$ is a group —O—$(Y_2—O)_{m_2}—R_2$, then $R_2$ is hydrogen, and $z_1'$ and $z_2'$ are each an integer 1 to 47, the sum of all integers $z_1'$ and $z_2'$ being 5 to 50, and when relevant, the sum of all the integers $z_1'$, $z_{2'}$ and $m_2$ being 6 to 100; particularly the compounds of formula In b, In b

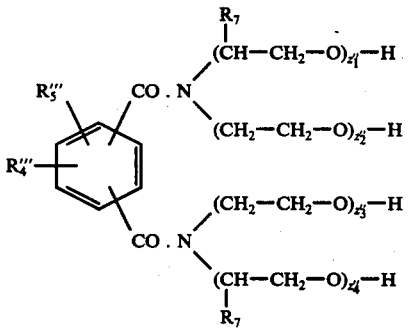

wherein $R_4'''$, $R_5'''$ and $R_7$ are as defined above, and $z_1''$, $z_2''$, $z_3''$ and $z_4''$ are each an integer 1 to 37, the sum of $z_1''$, $z_2''$, $z_3''$ and $z_4''$ being 5 to 40, particularly 5 to 20, especially the compounds of formula In c, In c

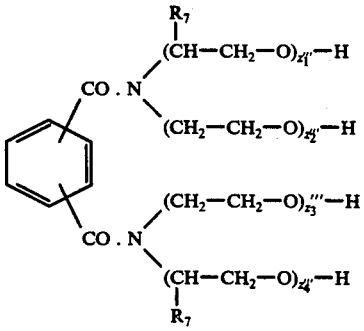

wherein $R_7$ is as defined above, and $z_1'''$, $z_2'''$, $z_3'''$ and $z_4'''$ are each an integer 1 to 17, the sum of $z_1'''$, $z_2'''$, $z_3'''$ and $z_4'''$ being 5 to 20, particularly 6 to 8, more especially the compounds of formula Id.

In general, the compounds of formula I may be produced in an analogous manner to the known methods for producing compounds of this type [Houben-Weyl, Methoden der Organischen Chemie, volume VI/3 p 367 et seq and volume XI/2 p 233 et seq].

Thus, for example, the compounds of formula I may be produced by condensing the appropriate carboxylic acid or carboxylic acid reactive functional derivative with an appropriate polyolefin glycol or polyolefin glycol derivative.

Suitable carboxylic acid starting materials for the production of compounds of formula I are, for example:

Benzoic acid, salicylic acid, p-methoxybenzoic acid, m-hydroxybenzoic acid, cresotinic acid, p-chlorobenzoic acid, o-, m- or p-toluic acid, p-cyanobenzoic acid, sulphosalicylic acid, phthalic acid, sulphophthalic acid, isophthalic acid, terephthalic acid, hemimellitic acid, trimellitic acid, trimesic acid, mellophanic acid and pyromellitic acid.

The esters or polyesters of formula I may be obtained by the known methods from the aromatic acids, their esters with low-molecular aliphatic alcohols ($C_1$-$C_4$), from the acid chlorides or anhydrides, preferably methyl benzoate, dimethyl terephthalate or phthalic anhydride and a polyethylene glycol of a molecular weight between, for example, 400 and 2000, preferably between 600 or 1000, or a mixed polyethylene polypropylene glycol or a polyglycol etherified on one side with an alkyl radical, if necessary with the addition of an acid catalyst.

In accordance with a particular aspect of the invention, compounds of formula In may be produced by reacting a compound of formula Ie, Ie

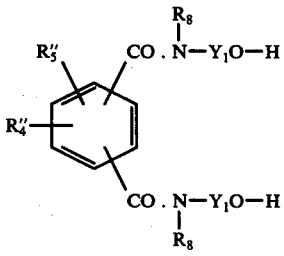

wherein $Y_1$, $R_4''$ and $R_5'$ are as defined above, and $R_8$ is hydrogen or a group —$Y_2$OH, wherein $Y_2$ is as defined above, with ethylene epoxide, propylene epoxide, butylene-1,2-epoxide or phenylethylene epoxide.

The process for the production of a compound of formula In, in accordance with the invention, may, for example, be effected as follows.

The compound of formula Ie is preferably dissolved in a solvent and the epoxide, in the appropriate molar relative amount added thereto. The reaction is preferably effected in the presence of a small amount of alkali, e.g. sodium hydroxide, as catalyst. The reaction temperature is preferably above room temperature but not so high that epoxylation ensues uncontrolled. Thus, preferably the reaction is initially effected at a temperature, e.g. between 100° to 150° C, especially 120° to 140° C so that epoxylation or initial epoxylation is effected on the amide nitrogen. This is relevant to the case where $Y_1$ is different to $Y_2$ and $R_8$ is hydrogen so that control of the epoxide addition is permitted. Thus, if subsequently the temperature is further raised, e.g. to between 150° to 170° C, and a different epoxide is added, addition will be localised to the terminal —OH of the —$Y_1$OH or the —$Y_2$OH groups, increasing the chain length thereof.

The relative amount of epoxide or epoxides is determined by the desired chain lengths of the side chains $-(Y_1O)_{z_1}-H$ and $-(Y_2O)_{z_2}-H$ in the final compound.

Working up is effected in conventional manner.

The compounds of formula Ie may, for example, be produced by condensing a compound of formula III,

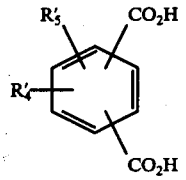

III wherein $R_4'$ and $R_5'$ are as defined above, or a reactive functional derivative thereof, with an alkanolamine of formula IV,

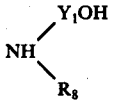

IV wherein $Y_1$ and $R_8$ are as defined above.

The process may, for example, be effected by adding the alkanolamine of formula IV to the acid of formula III or a reactive functional derivative thereof, e.g. an anhydride derivative, and the mixture heated, e.g. to between 100°–150° C, especially about 130° C, conveniently under reduced pressure to assist removal of water, or depending on the functional acid derivative employed, e.g. the condensed alcohol or halo acid, formed during the reaction. In general, the resulting compound is preferably employed directly in the process for producing the compound of formula In, excess alkanolamine conveniently being employed as solvent in both stages.

Examples of acids of formula III or acid derivatives thereof, are acids, esters, acid chlorides, anhydrides or cyclic imides, for example, dimethyl terephthalate and phthalic anhydride.

Examples of alkanol-amines of formula IV are ethanolamine and 2-amino-propanol.

As will be appreciated, the compounds of formula I, produced by the above-described processes or otherwise, will generally be obtained as mixtures comprising several compounds of formula I. While separation may be possible by conventional techniques, e.g. by chromatographic methods, in general and especially for use in the method of the invention which is described in further detail below, separation of the mixtures and isolation of the pure constituents is not considered warranted.

In the dyeing method of the invention, the compounds can, for example, be added to the dyeing baths. When employed in this way, in general, satisfactory results are obtained when the amount of the compound of formula I employed is between 1 and 10%, preferably 2 and 6%, based on the weight of the dyeing bath contents. When the fixing agents of the invention are employed for pre- or post-treatment of the fabric, then again in general, satisfactory results are obtained when employed in an amount of from 1 to 10%, preferably 2 to 6%, based on the weight of the dyeing bath contents used or to be used.

When employed for pre- or post-treatment of the fabric with respect to the dyeing step, then the compound may be dissolved or suspended in a suitable solvent or suspension medium. If necessary, surfactants such as those commonly available, may be employed.

In the printing method of the invention, the compounds are conveniently employed in a printing paste, said paste preferably also containing a thickening agent such as those commonly available. Examples of thickening agents are hydroxylated locust bean flour or alginate thickener. In general, satisfactory results are obtained when the compound of formula I is present in an amount of from 1 to 10%, preferably 2 to 6%, based on the weight of the printing paste. As regards the thickening agent, this may, for example, be employed in the range of from 40 to 80%, especially 50 to 70%, based on the weight of the paste.

The amount of dye employed in the dyeing and printing methods of the invention will naturally depend on the dye and intensity and shade of dye or print required. In general, however, the amount of dye employed in, e.g. the dyeing bath or printing paste, may be from 0.1 to 10%, particularly 1 to 6% by weight based on the weight of bath contents or printing paste.

The method of the invention preferably involves a final hot fixation treatment of the dye or printed fabric treated with the fixing agent. Such final step may be effected with hot air, super-heated or saturated steam at a temperature of between 100° and 170° C for a period of between 5 and 10 minutes.

The compounds of formula I, when employed as fixing agents in the method of the invention, enable accelerated fixation, good dye and printing yield, and fast and clearly outlined dyeings and prints.

The following Examples are intended to illustrate the invention without limiting its scope. The parts and percentages are by weight and the temperatures are in degrees Centigrade.

EXAMPLE 1

200 Parts of phthalic acid are introduced into 165 parts of monoethanolamine so slowly that the temperature of the mixture does not exceed 130°. After the introduction of the anhydride, heating is continued at 130°, if necessary under vacuum, until 24 parts of water are distilled off. The intermediate product is transferred in a hydroxethylating unit, heated again to 130°, for a short time under vacuum so as to eliminate the remaining water and then after the addition of 2 parts of NaOH, 350 parts of ethylene oxide are added. After the addition of 120 parts of ethylene oxide, the temperature may be raised up to 160°. The product has the following structure;

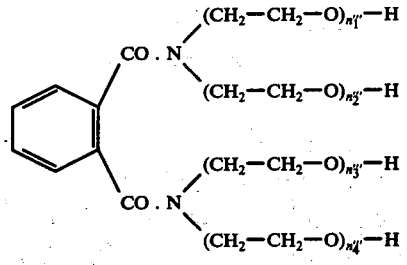

wherein $n_1'''$, $n_2'''$, $n_3'''$ and $n_4'''$ are integers of 1 to 5, the sum of $n_1'''$, $n_2'''$, $n_3'''$ and $n_4'''$ being 8;

it is liquid and can be directly used.

EXAMPLE 2

1000 Parts of methyl benzoate and 550 parts of 3-amino-propanol are heated at 140°–150° until 290 parts of methanol are distilled off. The intermediate product is transferred in a hydroxethylating unit, after the addition of 4 parts of NaOH heated to 150°, for a short time under vacuum to eliminate the remaining methanol, and approximately 2000 parts of ethylene oxide are added. The product is an amide from benzoic acid 3-amino-propanol and contains further 6 ethylene oxide groups per molecule; it is liquid and can be directly used.

EXAMPLE 3

In 100 parts of a polyglycol produced by the addition of ethylene oxide of a molecular weight of 2000 are mixed 20 parts of dimethyl terephthalate and 1% of the total weight p-toluic acid. The mixture is heated to 140°–150° until 6 parts of methanol are distilled off. 20 Parts of an emulsifier (for example, consisting of sulphonated fatty acid) are mixed with the polyester cooled to 80° and the pH is adjusted to 5–6 with aqueous ammonia. The product contains 1 mol of polyglycol radical per 2 mols of terephthalic acid radical.

EXAMPLE 4

200 Parts of phthalic anhydride are introduced into 165 parts of monoethanolamine so slowly that the temperature does not exceed 130°. After the introduction of the anhydride, the mixture is held under vacuum (10–20 Torr) to eliminate the water formed during the reaction, then 2 parts of NaOH are added and at 130° 130 parts of propylene oxide and finally 215 parts of ethylene oxide. During the addition of ethylene oxide, the temperature can be raised to 150°–160°. The product has the following structure;

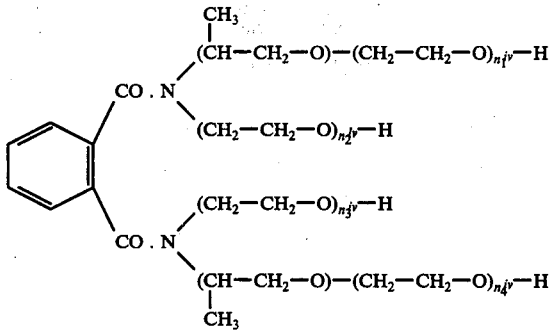

wherein $n_1^{IV}$, $n_2^{IV}$, $n_3^{IV}$ and $n_4^{IV}$ are integers 1 to 3, the sum of $n_1^{IV}$, $n_2^{IV}$, $n_3^{IV}$ and $n_4^{IV}$ being 6, it is liquid and can be directly used. The sequence of the addition of ethylene oxide and propylene oxide may be interchanged. The first half of the ethylene oxide is then added at 130° and during the addition of the other half and of the propylene oxide, the temperature may be raised to 150°–160°. The product is liquid and can be directly used.

Other compounds which can be produced in analogous manner are listed in the following Tables.

TABLE 1

| Auxiliary agent No. | Acid Type | Mol | Amine Type | Mol | Olefin oxide Type | Mol |
|---|---|---|---|---|---|---|
| 1 | Phthalic acid | 1 | 3-Aminopropanol | 2 | Ethylene oxide | 6 |
| 2 | Phthalic acid | 1 | Ethanolamine | 2 | Ethylene oxide | 3 |
| 3 | Phthalic acid | 1 | Ethanolamine | 1.5 | Ethylene oxide | 6 |
| 4 | Phthalic acid | 1 | Ethanolamine | 2 | Ethylene oxide | 12 |
| 5 | Phthalic acid | 1 | Ethanolamine | 1 | Propylene oxide | 3 |
| | | | Diethanolamine | 1 | Ethylene oxide | 6 |
| 6 | Terephthalic acid | | | | | |
| | Diethanolamine | 2 | Ethylene oxide | 6 | | |
| | | | | | Propylene oxide | 3 |
| 7 | Terephthalic acid | 1 | Ethanolamine | 2 | Butylene oxide | 4 |
| | | | | | Ethylene oxide | 4 |
| 8 | Isophthalic acid | 1 | Ethanolamine | 2 | Ethylene oxide | 8 |
| 9 | Benzoic acid | 1 | Ethanolamine | 1 | Ethylene oxide | 3 |
| 10 | Benzoic acid | 1 | 3-Methoxypropyl-amine | 1 | Propylene oxide | 2 |
| | | | | | Ethylene oxide | 4 |
| 11 | Benzoic acid | 1 | Diethanolamine | 1 | Styrene oxide | 1 |
| | | | | | Ethylene oxide | 6 |
| 12 | Benzoic acid | 1 | Ammonia | 1 | Ethylene oxide | 10 |
| 13 | Salicylic acid | 1 | 3-Aminopropanol | 1 | Ethylene oxide | 8 |
| 14 | p-Methoxybenzoic acid | 1 | Diethanolamine | 1 | Butylene oxide | 2 |
| | | | | | Ethylene oxide | 6 |
| 15 | m-Hydroxybenzoic acid | 1 | Ethanolamine | 1 | Ethylene oxide | 6 |
| 16 | Cresotinic acid | 1 | Ethanolamine | 1 | Ethylene oxide | 3 |
| 17 | p-Chlorobenzoic acid | 1 | Ethanolamine | 1 | Ethylene oxide | 8 |
| 18 | p-Toluic acid | 1 | Ethanolamine | 1 | Ethylene oxide | 6 |
| 19 | m-Toluic acid | 1 | Ethanolamine | 1 | Ethylene oxide | 6 |
| 20 | o-Toluic acid | 1 | Ethanolamine | 1 | Ethylene oxide | 6 |
| 21 | p-Cyanobenzoic acid | 1 | Ethanolamine | 1 | Ethylene oxide | 6 |
| 22 | Sulphosalicylic acid | 1 | Ethanolamine | 2 | Ethylene oxide | 6 |
| 23 | Pyromellitic acid | 1 | Ethanolamine | 4 | Ethylene oxide | 8 |

TABLE 2

| Auxiliary agent No | Acid Type | Mol | Alcohol Type | Mol |
|---|---|---|---|---|
| 24 | Benzoic acid | 2 | Polyethylene glycol 600 * | 1 |
| 25 | Benzoic acid | 1 | Polyethylene glycol 400 * | 1 |
| 26 | Benzoic acid | 1.5 | Polyethylene glycol 600 * | 1 |
| 27 | Phthalic acid | 1 | Polyethylene glycol 600 * | 1 |
| 28 | Phthalic acid | 2 | Polyethylene glycol 800 * | 1 |
| 29 | Phthalic acid | 1 | Polyethylene glycol 400 * | 2 |
| 30 | Phthalic acid | 1 | Polyethylene glycol 1000 * | 1 |
| 31 | Terephthalic acid | 1 | Polyethylene glycol 600 * | 1 |
| 32 | Terephthalic acid | 1 | Polyethylene glycol 1000 * | 1 |

TABLE 2-continued

| Auxiliary agent No | Acid Type | Mol | Alcohol Type | Mol |
|---|---|---|---|---|
| 33 | Terephthalic acid | 1 | Polyethylene glycol 2000 * | 1 |
| 34 | Terephthalic acid | 1.7 | Polyethylene glycol 800 * | 2 |
| 35 | Terephthalic acid | 1.3 | Polyethylene glycol 800 * | 2 |
| 36 | Terephthalic acid | 1 | Polyethylene-propylene-glycol 2000 * | 1 |
| 37 | Terephthalic acid | 1.5 | Polyethylene-propylene-glycol 2000 * | 2 |
| 38 | Isophthalic acid | 1 | Polyethylene glycol 600 * | 1 |
| 39 | Isophthalic acid | 2 | Polyethylene-propylene-glycol 2000 * | 1 |
| 40 | Isophthalic acid | 1 | Methoxypolyethylene-glycol 350 * | 2 |
| 41 | Phthalic acid | 1 | Methoxypolyethylene-glycol 350 * | 2 |
| 42 | Phthalic acid | 1 | Methoxypolyethylene-glycol 350 * | 1 |
| 43 | Terephthalic acid | 1 | Methoxypolyethylene-glycol 350 * | 2 |
| 44 | Terephthalic acid | 1.5 | Methoxypolyethylene-glycol 350 * | 2 |
| 45 | Benzoic acid | 1 | Methoxypolyethylene-glycol 350 * | 1 |
| 46 | Salicylic acid | 1 | Polyethylene glycol 400 * | 1 |
| 47 | Salicylic acid | 2 | Polyethylene glycol 600 * | 1 |
| 48 | Cresolinic acid | 2 | Polyethylene glycol 600 * | 1 |
| 49 | Sulphosalicylic acid | 2 | Polyethylene glycol 200 * | 1 |
| 50 | o-Toluic acid | 2 | Polyethylene glycol 600 * | 1 |
| 51 | m-Toluic acid | 2 | Polyethylene glycol 600 * | 1 |
| 52 | p-Toluic acid | 2 | Polyethylene glycol 600 * | 1 |
| 53 | p-Chlorobenzoic acid | 2 | Polyethylene glycol 600 * | 1 |
| 54 | p-Methoxybenzoic acid | 2 | Polyethylene glycol 600 * | 1 |
| 55 | p-Cyanobenzoic acid | 2 | Polyethylene glycol 600 * | 1 |
| 56 | Pyromellitic acid | 1 | Polyethylene glycol 200 * | 3.5 |

* the se numbers indicate the molecular weight.

EXAMPLE 5

A printing paste is produced from 60 parts of approximately 30% liquid dye

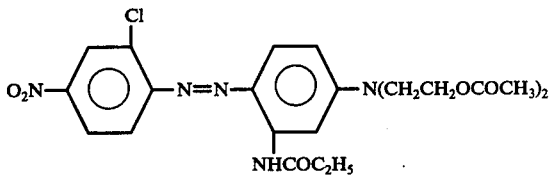

20 parts of auxiliary agent No. 1 according to Table 1, 600 parts of a thickening agent (hydroxethylated locust bean flour or alginate thickener) and completed with water to 1000 parts.

The pH is adjusted to 5 with glycolic acid and a continuous length of textile of polyester fibre is printed in conventional manner. After 6 minutes fixation in 160° hot steam and washing, a clear, deep ruby-coloured printing is obtained on the fibre.

EXAMPLE 6

A printing paste is produced from 15 parts of dye

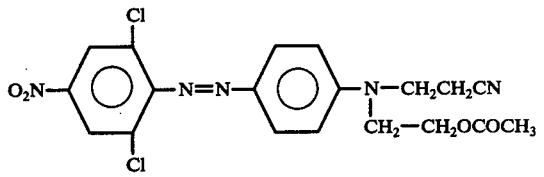

60 parts of auxiliary agent No. 12 (Table 1) and 600 parts of a thickener as in Example 5, completed with water to 1000 parts and the pH adjusted to 5 with glycolic acid.

A continuous length of textile of cellulose 2½-acetate fibre is printed in conventional manner. After 10 minutes fixation in 102° hot saturated steam and washing, a gold-brown printing in a deep shade is obtained on the fibre.

EXAMPLE 7

A printing paste is produced as in Example 5, nevertheless 12 parts of dye

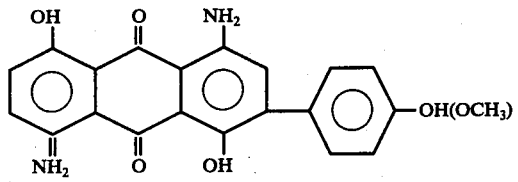

(a mixture of the phenolic compound and its methyl ether) and 60 parts of auxiliary agent No. 36 (Table 2) are used. A continuous length of textile of cellulose triacetate fibre is printed in conventional manner. After 6 minutes fixation in 160° hot steam and washing, a deep dark blue printing is obtained on the fibre.

What is claimed is:

1. In a process wherein a fabric consisting of or containing fibers of polyester, cellulose 2½ acetate, cellulose triacetate or polyvinyl chloride is dyed or printed, the improvement which comprises applying to the fabric before, during or after the dyeing or printing thereof a compound of the formula

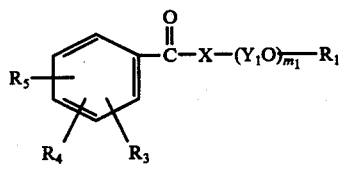

I wherein

X is —O— or —NR—,

R is hydrogen, phenyl, phenylalkyl ($C_7$-$C_{22}$), phenyl or phenylalkyl ($C_7$-$C_{22}$) substituted by —OH, alkyl or halogen and having up to 22 carbon atoms in the aggregate thereof, alkyl ($C_1$-$C_{22}$), cycloalkyl ($C_5$-$C_7$), alkyl ($C_1$-$C_{15}$) cycloalkyl ($C_5$-$C_7$), cycloalkyl ($C_5$-$C_7$) alkyl ($C_1$-$C_{15}$), alkyl ($C_1$-$C_{15}$) cycloalkyl ($C_5$-$C_7$) alkyl ($C_1$-$C_{15}$) or a group $—(Y_2—O)_{m_2}—R_2$ $Y_1$ and $Y_2$ are, independently, ethylene, 1,2-propylene, 1,3-propylene, 1,2-butylene or phenylethylene, with the proviso that a. only the group $Y_1$ or $Y_2$ which is bound to —X—, can be 1,3-propylene, and b. each ($Y_1$-O) or ($Y_2$-O) chain contains no more than 2 phenylethylene groups, $R_1$ and $R_2$ are, independently, hydrogen, phenyl, phenylalkyl ($C_7$-$C_{22}$), phenyl or phenylalkyl substituted on the phenyl nucleus by —OH, alkyl or halogen and having up to 22 carbon atoms in the aggregate thereof, alkyl ($C_1$-$C_{22}$), cycloalkyl ($C_5$-$C_7$), alkyl ($C_1$-$C_{15}$) cycloalkyl ($C_5$-$C_7$), cycloalkyl ($C_5$-$C_7$) alkyl ($C_1$-$C_{15}$), alkyl ($C_1$-$C_{15}$) cycloalkyl ($C_5$-$C_7$) alkyl ($C_1$-$C_{15}$), or a group

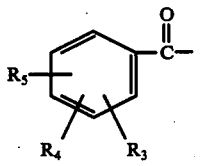

$R_3$ is hydrogen, halogen, alkyl ($C_1$-$C_{22}$), cycloalkyl ($C_5$-$C_7$), cycloalkyl ($C_5$-$C_7$) alkyl ($C_1$-$C_{15}$), alkyl ($C_1$-$C_{15}$) cycloalkyl ($C_5$-$C_7$), alkyl ($C_1$-$C_{15}$) cycloalkyl ($C_5$-$C_7$) alkyl ($C_1$-$C_{15}$), —CN, $—COOR_6$, $—SO_3R_6$, $—OR_6$, $—NHR_6$ or $—N(R_6)_2$, $—CO_2M$, $—SO_3M$ or a group $—CO—X—(Y_1O)_{m_1}—R_1$, $R_4$ is hydrogen, $—CO_2M$, $—OR_6$ or a group $—CO—X—(Y_1O)_{m_1}—R_1$, $R_5$ is hydrogen, $—CO_2M$ or a group $—CO—X—(Y_1O)_{m_1}—R_1$, M is a charge equivalent of a cation, $m_1$ and $m_2$ are integers 1 to 100, the sum of all integers $m_1$ and $m_2$ being 1 to 100, and $R_6$ is hydrogen or a group R.

2. A method according to claim 1, wherein said fabric treated with a compound of the formula

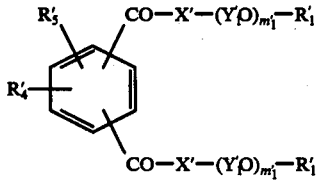

herein

X' is —O— or —NR'—

R' is hydrogen or a group $—(Y_2'O)_{m_2'}R_2'$ $Y_1'$ and $Y_2'$ are, independently, ethylene, 1,2-propylene or 1,2-butylene, $R_1'$ and $R_2'$ are, independently, hydrogen or alkyl ($C_1$-$C_4$), $R_4'$ is hydrogen, $CO_2M$ or $OR_6'$, $R_5'$ is hydrogen or $CO_2M$, $R_6'$ is hydrogen or a group $—(Y_2'O)_{m_2'}R_2'$ M is as defined in claim 1 and $m_1'$ and $m_2'$ are each an integer 1 to 49, the sum of all integers $m_1'$ and $m_2'$ being 2 to 50.

3. A method according to claim 2, wherein said fabric is treated with a compound of the formula,

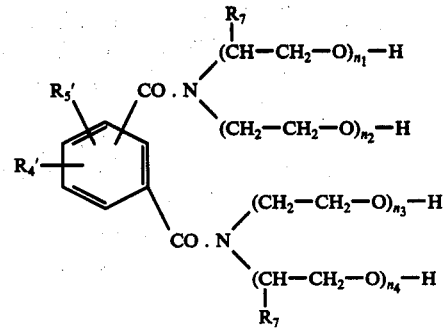

wherein, $R_7$ is hydrogen or methyl, and each of $n_1$, $n_2$, $n_3$ and $n_4$ is an integer 1 to 37, the sum of $n_1$, $n_2$, $n_3$ and $n_4$ being 4 to 40.

4. A method according to claim 3, wherein said fabric is treated with a compound of the formula,

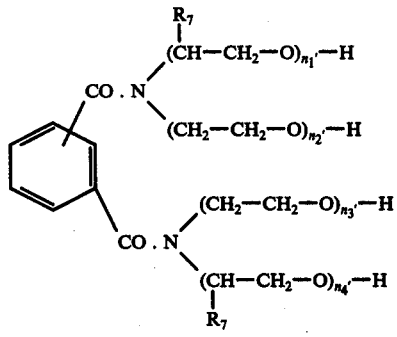

wherein $R_7$ is as defined in claim 3, and $n_1'$, $n_2'$, $n_3'$ and $n_4'$ are each an integer 1 to 17, the sum of $n_1'$, $n_2'$, $n_3'$ and $n_4'$ being 4 to 20.

5. A method according to claim 4, wherein said fabric is treated with a compound of the formula,

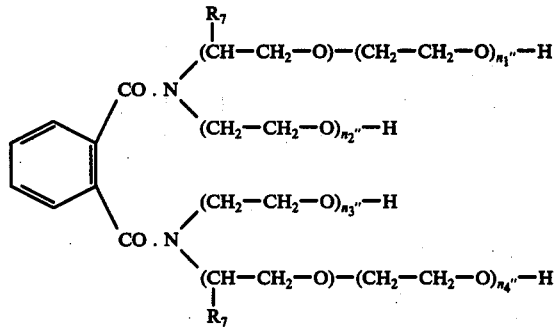

wherein $R_7$ is as defined in claim 4 and $n_1''$, $n_2''$, $n_3''$ and $n_4''$ are integers 1 to 3, the sum of $n_1''$, $n_2''$, $n_3''$ and $n_4''$ being 4 to 6.

6. A method according to claim 1, wherein —X— is —NR—.

7. A method according to claim 1, wherein each of $R_4$ and $R_5$ is hydrogen.

8. A method according to claim 1, wherein $R_1$ and $R_2$ are each hydrogen.

9. A process according to claim 1 wherein the dye is a disperse dye.

10. A process according to claim 1 wherein the fabric is dyed in a dye bath or printed with a printing paste and the compound of formula I is employed in an amount of from 1 to 10%, by weight, of the dye bath or the printing paste.

11. A process according to claim 10 wherein the compound of formula I is employed in the dye bath or the printing paste.

12. A process according to claim 10 wherein the compound of formula I is dissolved in a solvent or suspended in a suspension medium and applied before or after the dyeing.

13. A process according to claim 1 wherein the fabric is subjected to hot air or super-heated or saturated steam at a temperature of 100° to 170° C. following the dyeing or printing and application of the compound of formula I.

14. A printing paste for fabric consisting of or containing fibers of polyester, cellulose 2½ acetate, cellulose triacetate or polyvinyl chloride, which paste contains a thickening agent and, as fixing agent, 1 to 10% by weight of a compound of formula I as defined in claim 1.

15. A fabric dyed or printed according to the process of claim 1.

* * * * *